US007299883B2

(12) United States Patent
Wielgat

(10) Patent No.: US 7,299,883 B2
(45) Date of Patent: Nov. 27, 2007

(54) APPARATUS AND METHOD FOR EXTINGUISHING FIRES IN A MULTI-FLOORED BUILDING

(76) Inventor: Michael Wielgat, 10127 S. Hoyne St., Chicago, IL (US) 60643

( * ) Notice: Subject to any disclaimer, the term of this patent is extended or adjusted under 35 U.S.C. 154(b) by 0 days.

(21) Appl. No.: 11/435,656

(22) Filed: May 17, 2006

(65) Prior Publication Data

US 2007/0062712 A1 Mar. 22, 2007

Related U.S. Application Data

(60) Provisional application No. 60/695,798, filed on Jun. 30, 2005.

(51) Int. Cl.
*A62C 8/00* (2006.01)

(52) U.S. Cl. ..... 169/48; 169/47; 169/69; 169/45; 169/52; 169/46; 169/51; 239/282; 239/273; 239/280.5; 239/280; 254/414

(58) Field of Classification Search ..... 169/45, 169/46, 47, 48, 49, 69, 70; 239/80; 254/414; 414/728, 718
See application file for complete search history.

(56) References Cited

U.S. PATENT DOCUMENTS 245,168 A * 8/1881 Hopkins ..... 239/461
473,716 A * 4/1892 Stevens ..... 239/531
483,001 A * 9/1892 Hughes ..... 182/51
589,244 A * 8/1897 Cantore ..... 169/47
2,446,093 A * 7/1948 Lambert ..... 248/237
3,212,604 A * 10/1965 Garnett ..... 182/51
3,337,071 A * 8/1967 Clark ..... 414/728
4,043,397 A * 8/1977 Glowienke ..... 169/45
4,103,841 A * 8/1978 Flynn et al. ..... 242/390.3
4,261,434 A * 4/1981 Mitchell ..... 182/40
4,470,229 A * 9/1984 Muse et al. ..... 52/118
6,035,940 A * 3/2000 Bourke ..... 169/47
6,425,537 B1 * 7/2002 Nielsen ..... 239/443
6,881,021 B1 * 4/2005 Winter et al. ..... 414/420
7,028,783 B2 * 4/2006 Celorio-Villasenor ..... 169/46
2002/0100898 A1 * 8/2002 Knoerzer et al. ..... 254/134.3 R

* cited by examiner

*Primary Examiner*—Kevin Shaver
*Assistant Examiner*—Trevor McGraw
(74) *Attorney, Agent, or Firm*—Schwartz Cooper Chartered

(57) ABSTRACT

An apparatus for treating a fire in a multi-floored building, a method of treating fire in a multi-floored building, and a portable apparatus for assembly and subsequent treating of a fire in a multi-floored building are disclosed. The apparatus, method and system include a curvilinear tubular structure and a bracing system coupled to a source of a fluid pressure.

4 Claims, 8 Drawing Sheets

APPARATUS AND METHOD FOR EXTINGUISHING FIRES IN A MULTI-FLOORED BUILDING

RELATED APPLICATION

This Application claims the benefit of Provisional Patent Application Ser. No. 60/695,798 filed Jun. 30, 2005.

TECHNICAL FIELD

The invention relates to an apparatus for fighting fires. More specifically, the present invention relates to an apparatus including a portable apparatus and method for extinguishing a fire in a multi-floored building.

BACKGROUND

It is often difficult to extinguish a fire in a high-rise building because the floor or floors on which the fire is located is/are inaccessible due to the heat accompanying the fire. This excessive heat will often cause windows to blow out. The open windows allow oxygen to feed the fire creating an even more difficult situation.

High-rise buildings typically have sprinkler systems to help extinguish fires and help firefighters access the burning floors. Many times, these sprinkler systems are not sufficient to battle a hot and out of control fire, especially when the windows of the building have already blown out. If the fire is located on a lower floor, a fire truck ladder can be used to lift a firefighter toward the open windows and douse the burning floor with water or foam. However, when the floor is beyond the reach of the ladder, there is very little chance that firefighters will be able to access the burning floors until some cooling takes place.

SUMMARY OF THE INVENTION

One aspect of the present invention is directed to an apparatus for treating a fire in a multi-floored building, the fire located on a first floor vertically displaced from a second floor from which the fire is treated, the first and second floors each having a selectively openable environmental access along an external wall of the multi-floored building, the apparatus comprising:

- a curvilinear tubular structure having an inlet for receiving a fluid pressure at the second floor, an intermediate portion, and an outlet for delivering the fluid pressure to the first floor, the intermediate portion located between the inlet and the outlet and adapted for extension from the second floor environmental access and adjacent the first floor environmental access; and
- a bracing system attachable to said curvilinear tubular structure for supporting said curvilinear tubular structure against the multi-floored building.

The curvilinear tubular structure may comprise a plurality of tubular segments joined together. The plurality of tubular segments may include at least two curvilinear tubular segments. The plurality of tubular segments may be joined by fittings. The fittings may be storz fittings. The storz fittings may be 2½ in. storz fittings. Alternatively, the fittings may threads. Alternatively, the fittings may be chicago fittings.

The curvilinear tubular structure may be produced from a metallic material. The metallic material may an anodized aluminum.

The curvilinear tubular structure may be produced from a polymeric material. The polymeric material may be a polyvinyl chloride.

The bracing system may include a first brace attached to said curvilinear tubular structure and adapted to engage the multi-floored building at the first floor. The first brace may be located adjacent said curvilinear tubular structure outlet within the first floor environmental access.

The bracing system may further include a second brace attached to said curvilinear tubular structure and located along said intermediate portion and adapted to engage the outer wall of the multi-floored building between the first floor and the second floor.

The bracing system may further include a third brace attached to said curvilinear tubular structure adjacent said curvilinear tubular structure inlet and adapted to engage the multi-floored building within the second floor environmental access.

The bracing system may comprise a bracket extending outwardly from said curvilinear tubular structure and a support pivotally attached to said bracket. The support may include an elongated telescoping member. The support maybe spring loaded. The bracket may include a plurality of holes in radial alignment, said telescoping member being radially adjustable for placement in a fixed radial position by placement of a keeper through said telescoping member and at least one if said plurality of holes. The telescoping member may include a pivotally mounted pad adapted for engagement with the multi-floored building.

The bracing system may include a curvilinear support attached to said curvilinear tubular structure, said curvilinear support having opposing telescoping members and pivotally mounted opposing pads adapted for engagement with the multi-floored building.

The bracing may include a rigid frame and boom, the rigid frame extendable from the second floor environmental access and attachable to a portion of the multi-floored building, the rigid frame having an upwardly extending pivot point including a receiver for receiving a portion of said boom, said boom including a pivot point receivable into said receiver such that an outermost portion of said boom may be selectively pivoted upwardly about said pivot point, wherein said curvilinear tubular structure may be attached to said boom for corresponding pivotal movement and selective placement of said curvilinear tubular structure outlet adjacent the first floor environmental access.

The apparatus may comprise an eye loop joined to said curvilinear tubular structure.

The curvilinear tubular structure may have a diameter of 2½ ins.

The invention is also directed to an apparatus for treating a fire in a multi-floored building, the fire located on a first floor vertically displaced from a second floor from which the fire is treated, the first and second floors each having a selectively openable environmental access, the apparatus comprising:

- a plurality of tubular segments, at least two of the plurality of tubular segments having a curvilinear shape;
- a plurality of fittings joining the plurality of tubular segments to form a curvilinear tubular structure such that a distal member of the plurality of tubular segments forms an outlet which may be selectively located on the first floor, and a proximal member of the plurality of tubular segments forms an inlet which may be selectively located on the second floor, the at least two of the curvilinear shaped tubular segments being separated by at least one substantially straight tubular segment;

a first brace attached to the curvilinear tubular structure adjacent the curvilinear structure outlet and engageable with a portion of the multi-floored building within the first floor environmental access;

a second brace attached to the tubular structure between the at least two curvilinear shaped segments and engageable with a portion of the multi-floored building between the first and second floors;

a third brace attached to the curvilinear tubular structure adjacent the curvilinear structure inlet and engageable with a portion of the multi-floored building within the second floor environmental access; and a nozzle attached to the curvilinear tubular structure outlet wherein the curvilinear tubular structure is adapted in size and shape to be passed from the second floor environmental access into the first floor environmental access such that each the brace engages a portion of the multi-floored building, and a fluid pressure may be applied to the curvilinear tubular structure inlet and expelled via the nozzle to treat the fire.

The invention is further directed to a method for treating a fire in a multi-floored building, the fire located on a first floor vertically displaced from a second floor from which the fire is treated, the first and second floors each having a selectively openable environmental access, the method comprising the steps of:

providing a source of fluid pressure;

providing a plurality of tubular segments each having an inlet and an outlet, at least two of the plurality of tubular segments having a curvilinear shape;

providing a plurality of fittings to connect each of the plurality of tubular segments to an adjacent tubular segment;

forming a curvilinear tubular structure by connecting the plurality of tubular members to each other using the plurality of fittings such that a distal member of the plurality of tubular segments forms an outlet which may be selectively located on the first floor, and a proximal member of the plurality of tubular segments forms an inlet which may be selectively located on the second floor, the at least two of the curvilinear shaped tubular segments being separated by at least one substantially straight tubular segment;

providing a first brace for engaging the curvilinear tubular structure adjacent the curvilinear structure outlet and a portion of the multi-floored building within the first floor environmental access;

providing a second brace for engaging the tubular structure between the at least two curvilinear shaped segments and a portion of the multi-floored building between the first and second floors;

providing a third brace for engaging the curvilinear tubular structure adjacent the curvilinear structure inlet and a portion of the multi-floored building within the second floor environmental access;

joining a nozzle to the curvilinear tubular structure outlet;

passing the curvilinear tubular structure from the second floor environmental access into the first floor environmental access such that the first second and third braces engage portions of the multi-floored building; and joining the source of fluid pressure to the curvilinear tubular structure, wherein a fluid pressure is expelled from the nozzle to treat the fire.

The present invention is further directed to a portable apparatus for assembly and subsequent treating of a fire in a multi-floored building, the fire located on a first floor vertically displaced from a second floor from which the fire is treated, the first and second floors each having a selectively openable environmental access, the portable apparatus comprising:

a plurality of tubular segments capable of delivering fluid pressures in excess of 80 psi therethrough, at least two of the plurality of tubular segments having a curvilinear shape;

a plurality of fittings for joining each of the plurality of tubular segments wherein the plurality of tubular segments may be selectively assembled into a curvilinear tubular structure wherein a distal member of the plurality of tubular segments forms an outlet which may be selectively located on the first floor, and a proximal member of the plurality of tubular segments forms an inlet which may be selectively located on the second floor; and a plurality of braces connectable to the curvilinear tubular structure and adapted to stabilize the curvilinear tubular against the multi-floored building.

The present invention is further directed to an apparatus for treating a fire in a multi-floored building, the fire located on a first floor vertically displaced from a second floor from which the fire is treated, the first and second floors each having a selectively openable environmental access along an external wall of the multi-floored building, the apparatus comprising:

a curvilinear tubular structure having an inlet for receiving a fluid pressure at the second floor, an intermediate portion, and an outlet for delivering the fluid pressure to the first floor, the intermediate portion located between the inlet and the outlet and adapted for extension from the second floor environmental access to adjacent the first floor environmental access via telescopic means; and a bracing system attachable to the curvilinear tubular structure for supporting the curvilinear tubular structure against the multi-floored building.

The bracing system may include a first frame supported against a portion of the multi-floored building adjacent the second floor environmental access. The first frame may include a clamp fixing the first frame to a portion of the multi-floored building The bracing system may further include a second frame in an engagement with the first frame and a portion of the multi-floored building within the second floor environmental access. The second frame may have hydraulic jacks for extending an upper portion of the second frame against a portion of the multi-floored building.

The bracing system may further include a boom attached to the curvilinear tubular structure and in engagement with a portion of the first frame and pivotable thereon. The boom may include a plurality of extension members for increasing the length of the boom The apparatus may be portable.

BRIEF DESCRIPTION OF THE DRAWINGS

To understand the present invention, it will now be described by way of example, with reference to the accompanying drawings in which.

DETAILED DESCRIPTION

Figure 3:
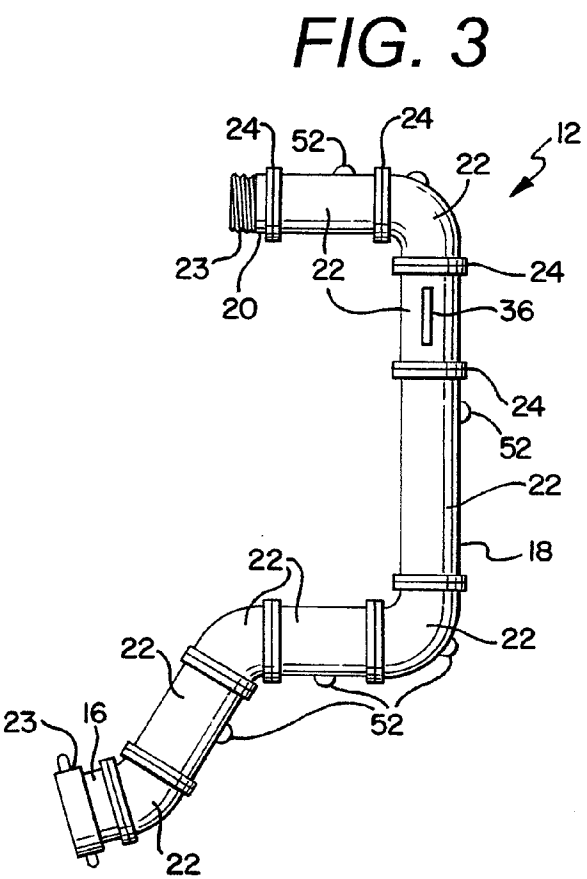
FIG. 3 is a side view of a curvilinear tubular structure.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

LISTING OF REFERENCE NUMBERS

Apparatus 10;
Curvilinear tubular structure 12;
Bracing system 14;
Inlet 16;
Intermediate portion 18;
Outlet 20;
Nozzle 21;
Tubular segments 22;
Coupling 23;
Fittings 24;
First brace 26;
Second brace 28;
Third brace 30;
Rings 31;
Hook 32;
Support 34;
Bracket 36;
Holes 38;
Center hole 39;
Pins 40;
Elongated telescoping members 42;
Rigid frame 44;
Clamps 45;
Boom 46;
Boom extensions 47;
Receiver 48;
Cylindrical member 50;
Eye loops 52;
Cable 53;
Telescopic waterway assembly 54;
Larger diameter first pipe segment 56;
Smaller diameter second pipe segment 58;
A first retaining ring 60;
A wiper 62;
A first bearing 64;
A seal 66;
A second bearing 68;
A third bearing 70;
A second retainer 72;
Brackets 74;
Extendable frame 76;
Extendable frame upper portion 78;
Extendable frame lower portion 80;
Hydraulic jacks 82;
Multi-floored building 100;
Lower floor 102;
Upper floor 104;
Lower floor environmental access 106;
Upper floor environmental access 108;
Inner wall 110;
Outer wall 112;
Source of fluid pressure 200.

The present invention is directed to an apparatus for treating a fire in a multi-floored building, a method of treating fire in a multi-floored building, and a portable apparatus for assembly and subsequent treating of a fire in a multi-floored building. It is contemplated that various disclosures described herein are used to treat a fire located on a first floor that is vertically displaced from a second floor from which the fire is treated. The first and second floors each have a selectively openable environmental access, e.g. a window or other suitable opening, along an external or outer wall of the multi-floored building.

The apparatus of the present invention is preferably supplied as a system in multiple smaller components that can be transported to a location and assembled in various sizes, lengths, and shapes.

Figure 2:
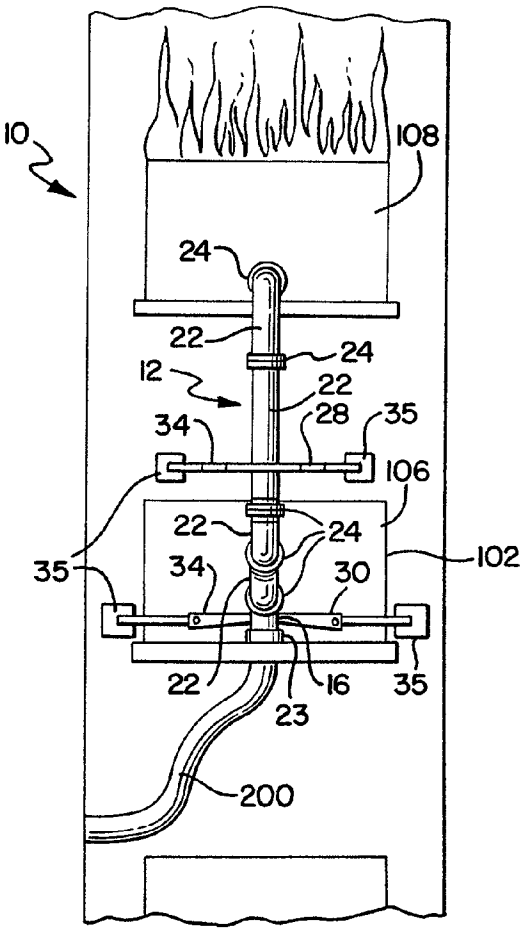
FIG. 2 is a front view of the present invention.
Figure 1:
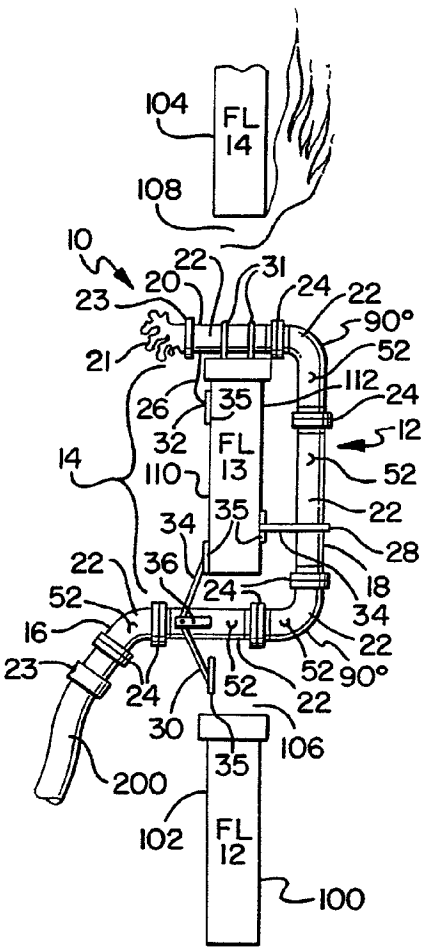
FIG. 1 is a side view of a system including a method and apparatus for treating a fire in a multi-floored building comprising a fully assembled system of the present invention.

Referring to the FIGS. 1 and 2, an apparatus 10 for treating a fire in a multi-floored building 100 is illustrated. The apparatus 10 includes a curvilinear tubular structure 12 and a bracing system 14 coupled to a source of a fluid pressure 200.

The curvilinear tubular structure 12 has an inlet 16 for receiving a fluid pressure on a lower floor 102, an intermediate portion 18, and an outlet 20 for delivering the fluid pressure to an upper floor 104. The intermediate portion 18 is located between the inlet 16 and the outlet 20 and is adapted for extension from a lower floor environmental access 106 to a point adjacent; i.e. either inside or outside, an upper floor environmental access 108. A nozzle 21 may be attached to the outlet 20 to redirect the fluid pressure.

The curvilinear tubular structure 12 is generally produced from a metallic material such as a steel, a stainless steel, or an anodized aluminum or alloy thereof, but can also be produced from polymeric substances such as polyvinyl chloride. The diameter of the tubular segments is typically on the order of about 2½ ins.

The curvilinear tubular structure 12 generally includes a plurality of tubular segments 22 joined together, preferably end-to-end. Any number of tubular segments 22 may be provided; however, at least two curvilinear tubular segments separated by at least one straight segment are preferably provided to allow the fluid pressure to be transferred from safely inside the lower floor 102 to inside the upper floor 104. These curvilinear tubular segments can take any angle between just greater than 0° and 180°, but are preferably made up of segments angled 45° and 90°. (See FIGS. 3 and 4) Siamese segments or any other type T-shape or Y-shape can also be provided as needed.

The curvilinear tubular structure 12 is formed by connecting the tubular segments 22 to each other using fittings 24, including threads, storz fittings, Chicago fittings, or any other suitable substantially fluid tight means for connecting tubular segments, including all quick-connect means and non-directional fittings. The segments 22 may also be welded, glued, friction fit, etc.

A storz fitting is the preferable means of connection. The storz fitting is a "symmetrical" fitting, which means that any storz fitting of a given size will connect to any other storz fitting of the same size. Many other fire services do not use this type of fitting, but instead have a system that uses male and female fittings, which means that the user has to pay attention to the orientation of the segment 22.

Figure 4:
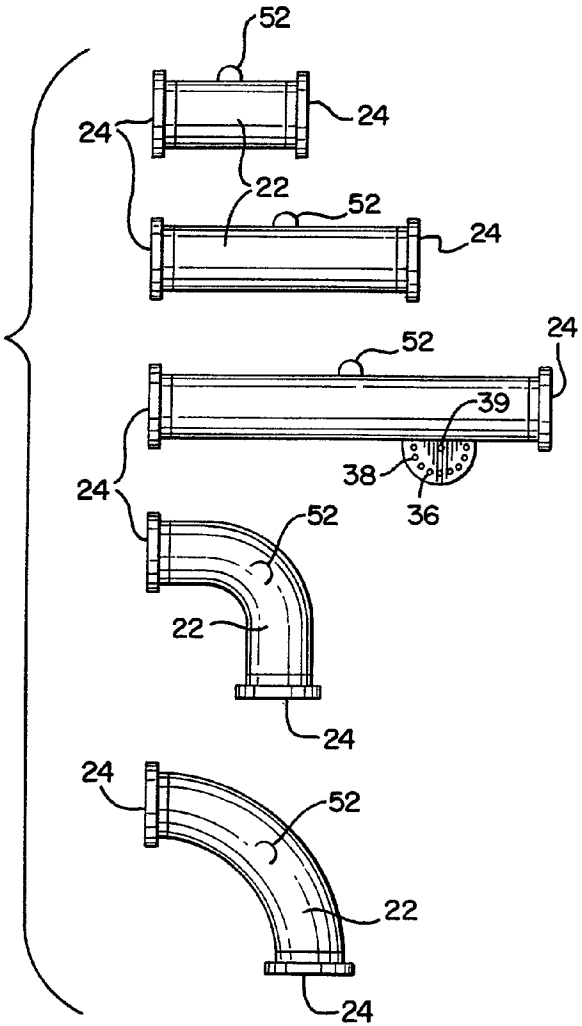
FIG. 4 is a side view of several examples of individual tubular segments including eye loops and brackets with radially aligned holes.

The tubular segments 22 are arranged such that a distal member forms the outlet 20 which may be selectively located on the first or upper floor 104, and a proximal member forms the inlet 16 which may be selectively located on the second or lower floor 102. As best illustrated in FIG. 3, the inlet 16 typically includes a coupling 23 for attachment to a source of fluid pressure 200, and the outlet 20 also includes a coupling 23 for attachment to the nozzle 21.

Referring again to FIGS. 1 and 2, the bracing system 14 is generally attachable to the curvilinear tubular structure 12. The bracing system 14 is provided for supporting the curvilinear tubular structure 12 against the multi-floored building 100. In some cases, the bracing system may be used as a means for hoisting the curvilinear tubular structure 12 into proper position.

The bracing system 14 preferably includes one or more (i.e. a plurality) of brace members. The brace members may be identical, similar, or substantially different from each other. Several types of braces are described below and illustrated in the figures. One of ordinary skilled in the art would appreciate that these types of braces can be used alone or in combination without departing from the spirit of the invention.

A first brace 26 is attached to the curvilinear tubular structure 12 and adapted to engage the multi-floored building 100 at the upper floor 104. This brace 26 is adapted to maintain the curvilinear tubular structure 12 adjacent the upper floor environmental access 108 either alone or in combination with other brace system elements when the apparatus 10 is pressurized with a fluid pressure of about 80 psi or higher. Accordingly, in the figures, the first brace 26 engages an inner wall 110 of the upper floor 104. Thus, as the fluid pressure exits the outlet 20, an outward kickback force is experienced by the curvilinear tubular structure 12, and the first brace 26 maintains the outlet 20 within or adjacent the upper floor environmental access 108.

A second brace 28 may also be attached to the curvilinear tubular structure 12. This second brace 28 is located along the intermediate portion 18 and is adapted to engage an outer wall 112 of the multi-floored building 100 between the upper floor 104 and the lower floor 102.

A third brace 30 may also be attached to the curvilinear tubular structure 12 adjacent the inlet 16 and is adapted to engage the multi-floored building 100 adjacent or within the lower floor environmental access 106, preferably against the inner wall 110.

Protective rings 31 can be added to the curvilinear tubular structure 12 to space from and prevent contact with the multi-floored building 100.

Figure 5:
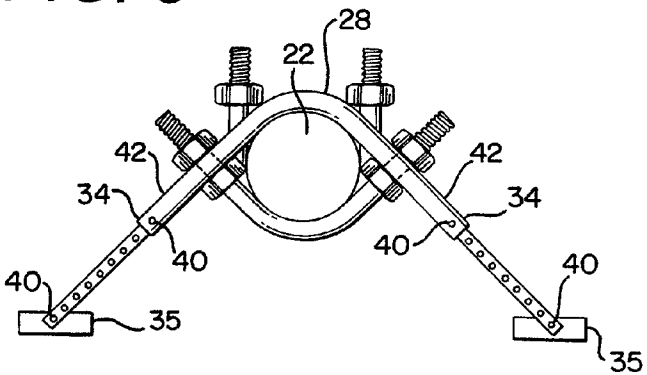
FIG. 5 is a top view of a first type of brace of an overall bracing system.
Figure 6:
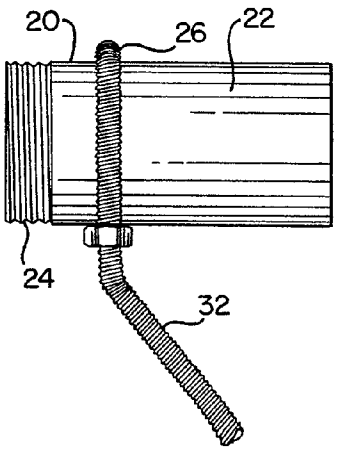
FIG. 6 is a side view of a second type of brace of an overall bracing system including a hook for engagement with an inner wall of an upper floor of a multi-floored building.

The various braces may include a hook-like structure 32 as provided with the first brace 26 (see also FIG. 6). The support 34 may have a curvilinear shape having opposing telescoping members with pivotally mounted opposing pads 35 adapted for engagement with the multi-floored building 100 as illustrated in FIG. 5. Another option includes a support 34 pivotally attached to a bracket 36 which is fixed to the curvilinear tubular structure 12 as provided with the third brace 28, 30.

Figure 8:
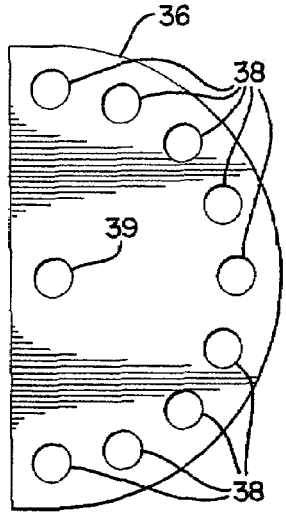
FIG. 8 is a top view of a bracket with radially aligned holes.
Figure 9:
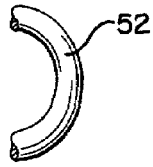
FIG. 9 is a top view of an eye loop.
Figure 10:
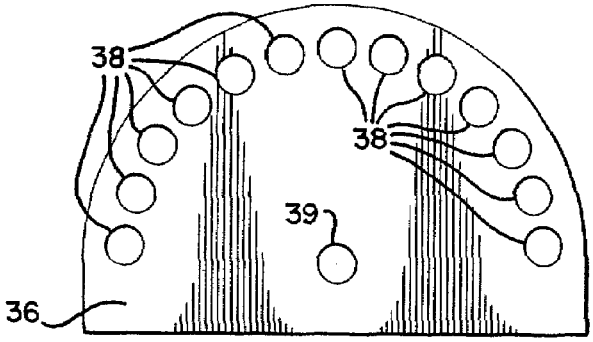
FIG. 10 is a top view of another bracket including radially aligned holes.
Figure 11:
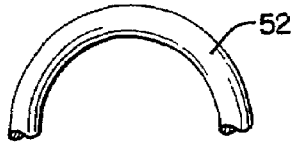
FIG. 11 is a top view of another eye loop.
Figure 12:
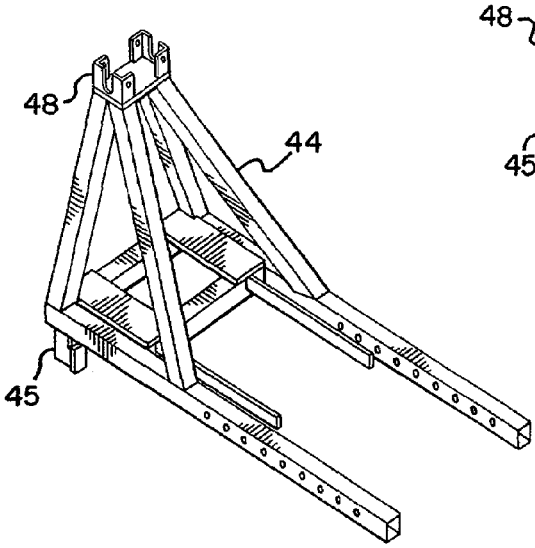
FIG. 12 is perspective view of a rigid frame of an overall bracing system having clamps for connection within an environmental access.
Figure 13:
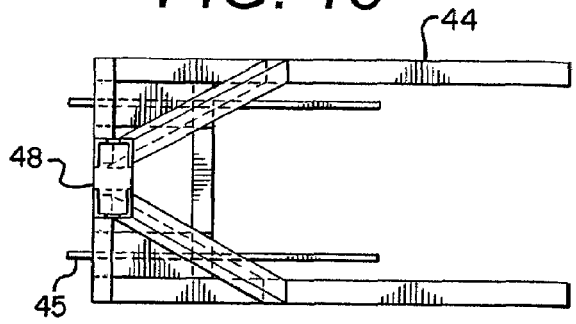
FIG. 13 is a top view of the rigid frame.
Figure 14:
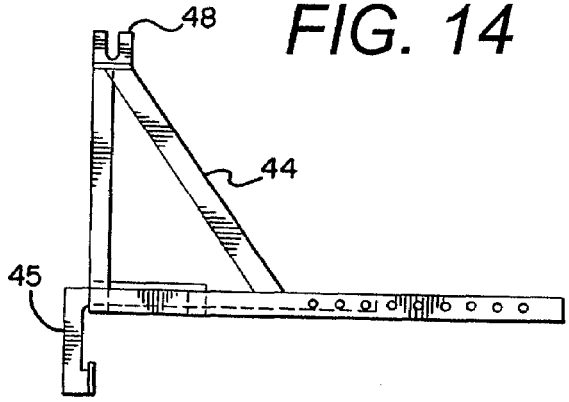
FIG. 14 is a front view of the rigid frame.
Figure 15:
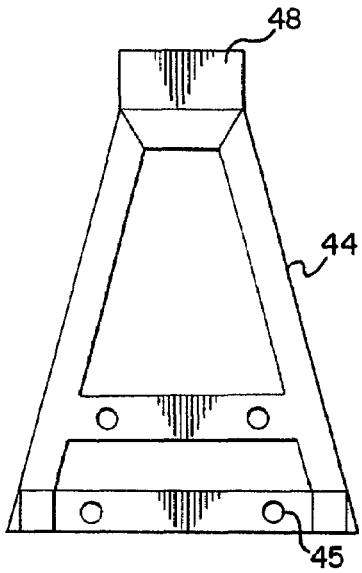
FIG. 15 is a side view of the rigid frame.
Figure 16:
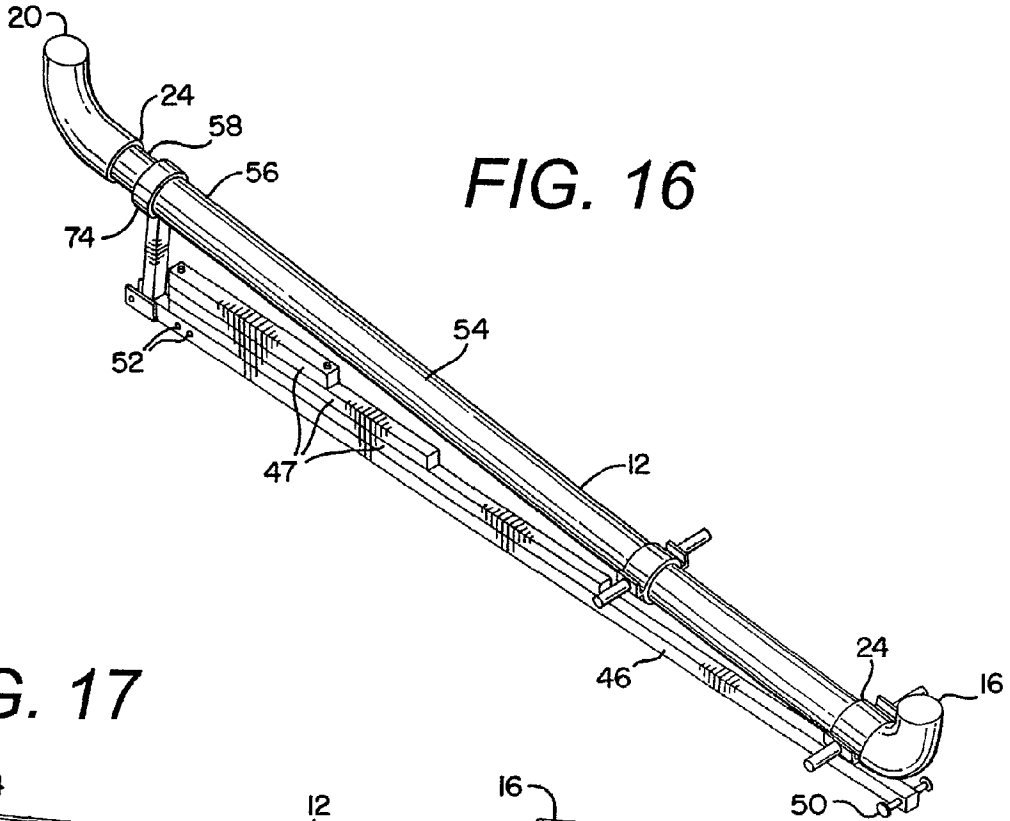
FIG. 16 is a perspective view of an extendable boom for use in conjunction with the rigid frame in an overall bracing system.
Figure 17:
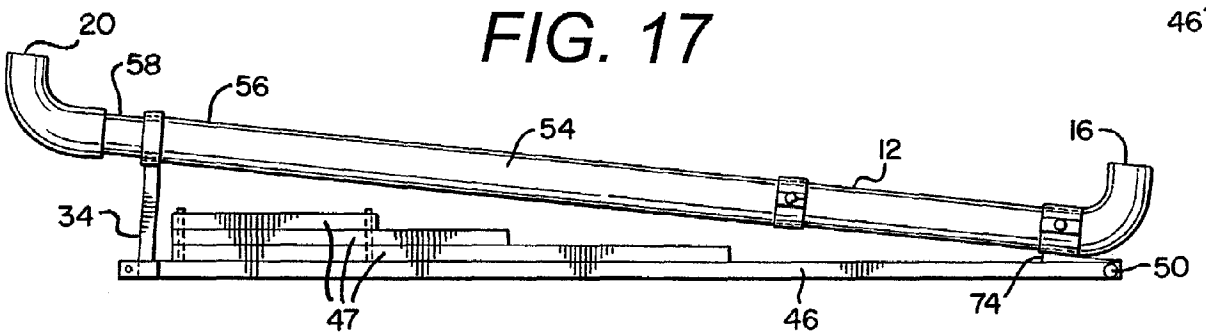
FIG. 17 is a cross-sectional view of an extendable boom for use in conjunction with the rigid frame in an overall bracing system.
Figure 18:
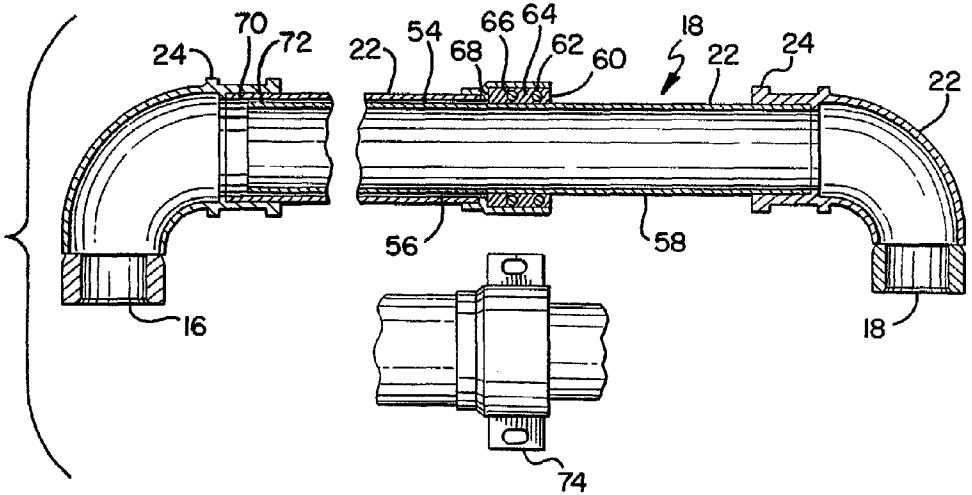
FIG. 18 is a cross-sectional view of a telescoping waterway section used with the apparatus.

In another example, the bracket 36 is fixedly attached to the curvilinear tubular structure 12, and may include a plurality of holes 38, preferably radially aligned with a center hole 39 (see FIGS. 8 and 10). The support 34 is attached to the bracket with pins or keepers 40.

Figure 7:
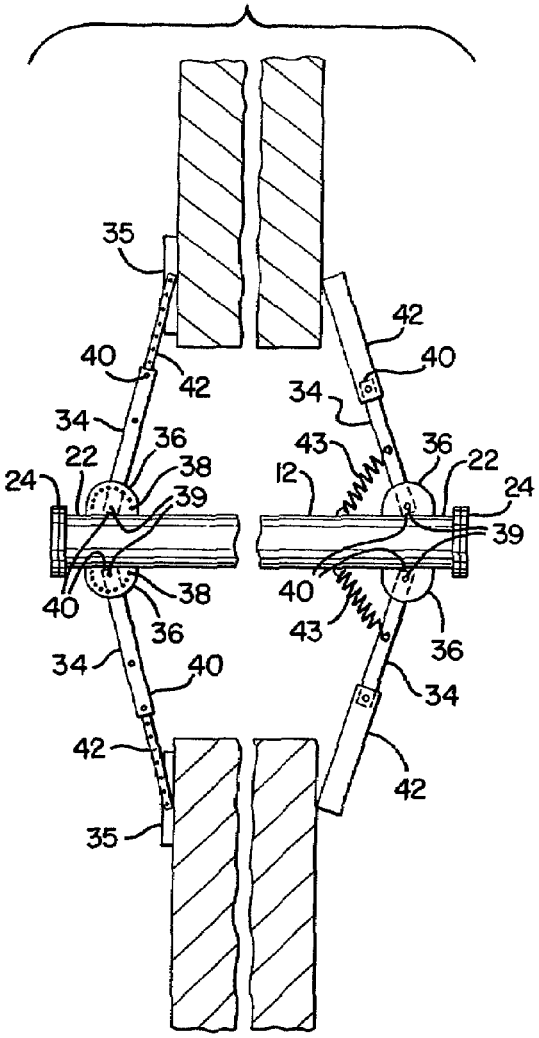
FIG. 7 is a top view of a pair of braces of an overall bracing system, one engaging the inner wall of a lower floor of a multi-floored building, the other a spring-loaded bracket engaging an outer wall of a multi-floored building between an upper floor environmental access and a lower floor environmental access.

As best illustrated in FIG. 7, the support 34 may also include opposing elongated telescoping members 42. Additional pins or keepers 40 may be provided to selectively lengthen or shorten the telescoping members 42. The telescoping member 42 is radially adjustable for placement in a fixed radial position by placement of the keeper 40 through the telescoping member 42 and at least one of the holes 38. The support 34 may be spring-loaded using elastic members 43 such as the springs shown in FIG. 7.

An alternative embodiment of the apparatus 10 is illustrated in FIGS. 12-21.

Referring specifically to FIGS. 12-17, the bracing system of this embodiment includes a rigid frame 44 and boom 46. The rigid frame 44 is extendable from the lower floor environmental access 106, and is attachable to a portion of the multi-floored building 100 through the use of a lever clam, such as the lever clamp sold by Bessey, Inc. under the name J-Series Lever Clamp, attached to a lower portion of the frame 44. The rigid frame 44 has an upwardly extending pivot point including a receiver 48 for receiving a portion of the boom 46.

Figure 20B:
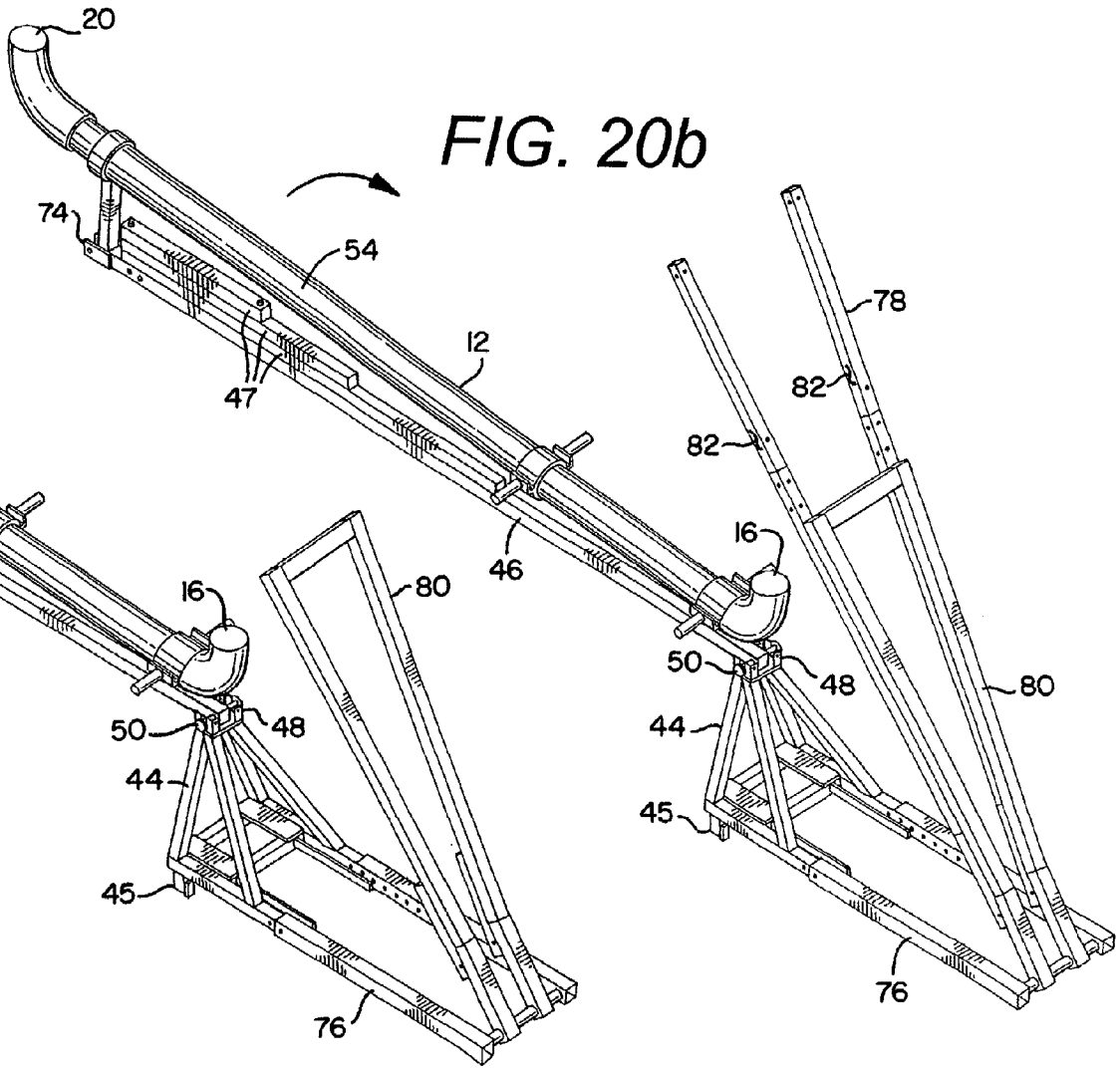
FIG. 20 is a perspective view of an apparatus of the present invention is a position to be hoisted upwardly to a higher floor's environmental access.
Figure 20A:
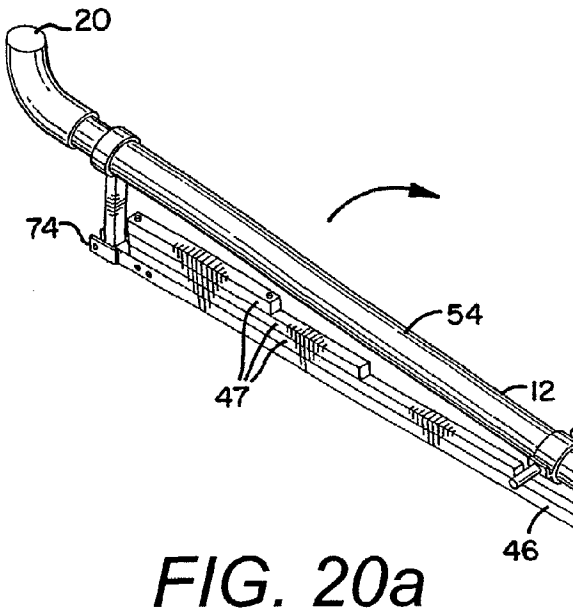
Figure 23:
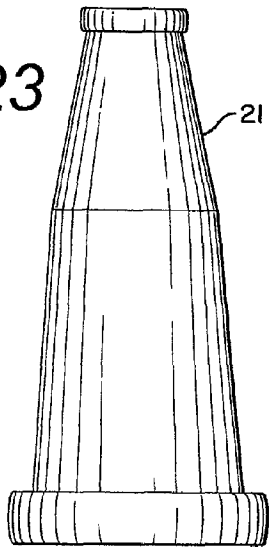
FIG. 23 is a cross-sectional view of a nozzle taken at 90 degrees of FIG. 22.
Figure 25:
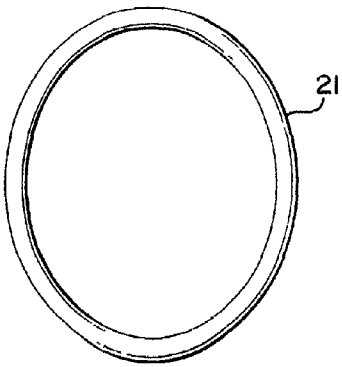
FIG. 25 is a bottom view of the entry end of the nozzle of FIG. 22.
Figure 22:
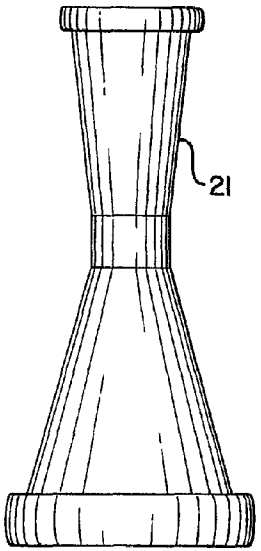
FIG. 22 is a cross sectional view of a nozzle for use with the present invention.
Figure 24:
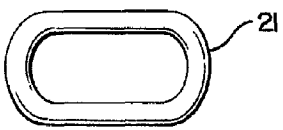
FIG. 24 is a top view of the delivery end of the nozzle of FIG. 22.

The boom 46 includes a pivot point and a cylindrical member 50 extending perpendicularly outwardly from the boom 46 and is receivable into the receiver 48 on the frame 44. An outer or outermost portion of the boom 46 may be selectively pivoted upwardly about the pivot point, as illustrated in FIGS. 20*a* and 20*b*. The curvilinear tubular structure 12 may be attached to the boom 46 for corresponding pivotal movement and selective placement of curvilinear tubular structure outlet 20 adjacent the upper floor environmental access 108. The boom 46 of this embodiment may be made longer by adding extensions 47*a-d* to the lengthen the boom 46 as illustrated in FIG. 21.

Figure 21:
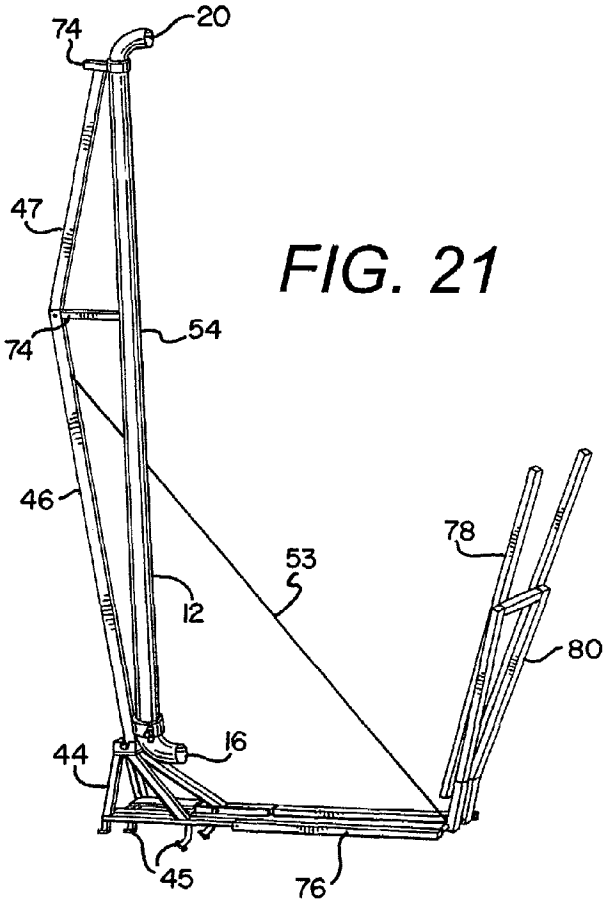
FIG. 21 is a perspective view of the apparatus of FIG. 20 in a fully extended position.

A plurality of apertures, e.g. in the form of eye loops 52 attached to the curvilinear tubular structure 12 and/or the boom 46, provide attachment points for a cable or cables 53 (see FIG. 21). The cable 53 may be attached or threaded through the aperture to aid in hoisting, adjusting, and/or stabilizing the boom and the curvilinear tubular structure 12 against any unwanted movement.

Referring to FIGS. 18*a* and 18*b*, the curvilinear tubular structure 12 of this embodiment is illustrated. This tubular structure includes an intermediate portion 18 having a telescopic waterway assembly 54. The telescopic waterway assembly 54 is adapted to selectively vary the length of the intermediate portion 18. This creates an advantage over previously described assemblies in that fewer segments 22 must be transported, lifted, assembled, coupled, etc. in order for the curvilinear tubular segment 12 to reach or extend from the lower floor environmental access 106 to an upper floor environmental access 108.

The telescopic waterway assembly 54 includes a first pipe segment 56 having a slightly larger diameter than a second pipe segment 58 which is at least partially disposed within the first pipe segment 56. At a distal end, the first pipe segment 56 includes a bearing and seal arrangement for at least substantially sealing the outer surface of the second pipe 58 yet allowing the second pipe 58 to traverse or provide telescopic movement within and extending from the first pipe 56. At a proximal end, the first pipe 56 is attached the remainder of the curvilinear tubular segment 12, either the entry end or the delivery end of the segment 12.

The bearing and seal arrangement includes a first retaining ring 60, a wiper 62, preferably of urethane, a first bearing 64, a seal 66, and a second bearing 68.

The second pipe 58 includes a third bearing 70 and a second retainer 72 for preventing the second pipe from complete withdrawal from the first pipe 56.

This tubular structure 12 also includes brackets 74 as necessary to which the extensions 47*a-d* may be attached when the tubular structure 12 and the boom are selectively lengthened.

Figure 19:
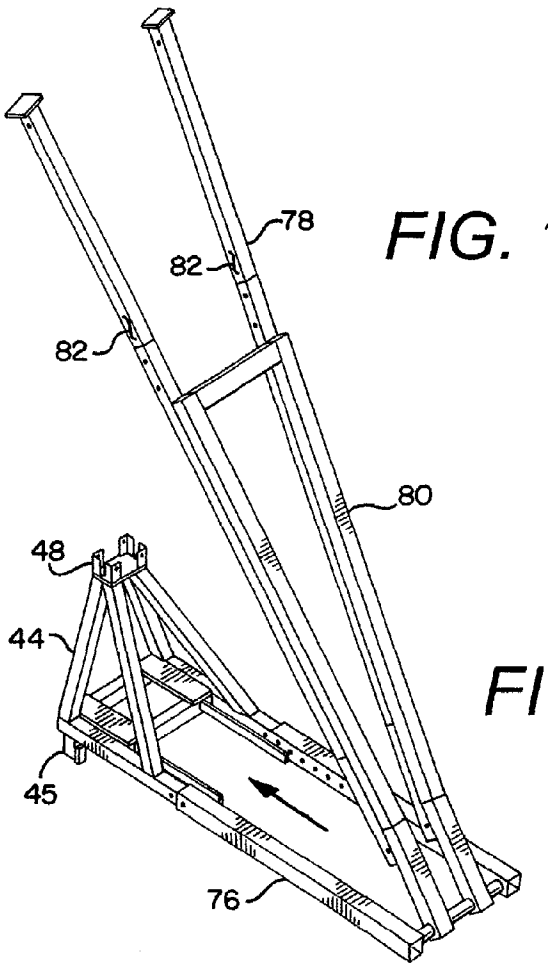
FIG. 19 is a perspective view of a rigid frame with a fully extended brace.

Referring to FIG. 19, the bracing system may further include an extendable frame 76. The extendable frame 76 is attachable to the frame 44 and includes an upper portion 78 pivotally attached to a lower portion 80. In use, the upper portion 78 can be pivoted about a pivot point to a substantially vertical position. The upper portion 78 includes hydraulic jacks 82, such hydraulic bracing bars sold by Save-A-Load, Inc. under the name Save-A-Load®, provided for extending the upper portion 78 upwardly against a portion of the lower floor 102, preferably the ceiling.

As illustrated in FIGS. 20*a* and 20*b*, the tubular structure 12 is attachable to the boom 46. The bracing system includes the rigid frame 44 and the extendable frame 76. The cylindrical member 50 of the boom 46 rests within the receiver 48 of the frame 44, and the boom 46/tubular structure 12 combination can be pivoted about the receiver 48 to access the upper floor environmental access 108.

FIG. 21 shows the entire assembly pivoted to access the upper floor. The apparatus 10 is designed to hold a nozzle 21 in a position that allows fire fighters to spray a stream of water one story above them through an environmental access in a tall building where all other access is unavailable. The apparatus comprises of three main assemblies: the curvilinear tubular structure 12, the nozzle 21, and the bracing system, including the rigid frame 44, the boom 46 and the extendable frame 76. The rigid frame 44 and the extendable frame 76 are positioned on the windowsill of a window below a floor of a tall building with a fire. The clamps 45 are locked onto the windowsill. The boom 46 and curvilinear tubular structure 12 are extended and pushed out of the window and locked into position on the stand with two pins. The extendable frame 76 is attached to the rigid frame 44, pivoted toward the ceiling, and the hydraulic jacks 82 of the upper portion 78 are used to extend the upper portion 78 against the ceiling. The nozzle 21 is pulled into position using the cable 53, preferably with a winch. When the nozzle 21 is in position the cable 53 is routed under the frames 44,76 and attached thereto and becomes part of the bracing system to hold the boom 46 in a substantially vertical position.

Taken in conjunction with the description above, a method for treating a fire in a multi-floored building where the fire is located on a first floor vertically displaced from a second floor from which the fire is treated is also disclosed in the FIGS. 1-21. The first and second floors each having a selectively openable environmental access. The method comprises one or more of the following the steps of: providing a source of fluid pressure, providing a plurality of tubular segments each having an inlet and an outlet, at least two of the plurality of tubular segments having a curvilinear shape, providing a plurality of fittings to connect each of the plurality of tubular segments to an adjacent tubular segment, providing a first brace for engaging the curvilinear tubular structure adjacent the curvilinear structure outlet and a portion of the multi-floored building within the first floor environmental access, providing a second brace for engaging the tubular structure between the curvilinear shaped segments and a portion of the multi-floored building between the first and second floors, providing a third brace for engaging the curvilinear tubular structure adjacent the curvilinear structure inlet and a portion of the multi-floored building within the second floor environmental access, joining a nozzle to the curvilinear tubular structure outlet, passing the curvilinear tubular structure from the second floor environmental access into the first floor environmental access such that the first second and third braces engage portions of the multi-floored building, and joining the source of fluid pressure to the curvilinear tubular structure, wherein a fluid pressure is expelled from the nozzle to treat the fire.

Further taken in conjunction with the description set forth above, a portable apparatus for assembly and subsequent treating of a fire in a multi-floored building is also disclosed in the FIGS. 1-21. The fire is located on a first floor vertically displaced from a second floor from which the fire is treated, the first and second floors each having a selectively openable environmental access. The portable apparatus comprises one or more of the following: a plurality of tubular segments or an extendable telescoping curvilinear tubular segment capable of delivering fluid pressures in excess of 80 psi therethrough, a plurality of fittings for joining the tubular segments wherein the tubular segments may be selectively assembled into a curvilinear tubular structure wherein a distal member of the tubular segments forms an outlet which may be selectively located on the first floor, and a proximal member of the tubular segments forms an inlet which may be selectively located on the second floor, and a plurality of braces connectable to the curvilinear tubular structure and adapted to stabilize the curvilinear tubular against the multi-floored building.

FIGS. 22-25 illustrate a nozzle 21 for use with he present invention. The nozzle 21 comprises a connection end for attachment to a pipe or hose and an exit end. The nozzle 21 is compressed at an intermediate portion so that it tapers from the connection end to the exit end which has an elongated oval shape. This shape causes the water flow to compress in the intermediate portion and again at the exit end to discharge a solid stream. This oval shape allows pressurized water to take-on a fan-shape as the pressurized water is expelled from the nozzle 21. This fan-shape ensures maximum coverage of the floor upon which the is located. As the distance from the exit end of the nozzle 21 increases, the area covered by the fan-shaped pressurized water pattern increases.

While the specific embodiments have been illustrated and described, numerous modifications come to mind without significantly departing from the spirit of the invention, and the scope of protection is only limited by the scope of the accompanying Claims.

What is claimed is:

1. An apparatus for treating a fire in a multi-floored building, the fire located on a first floor vertically displaced from a second floor from which the fire is treated, the first and second floors each having a selectively openable environmental access along an external wall of the multi-floored building, the apparatus comprising:

a curvilinear tubular structure having an inlet for receiving a fluid pressure at the second floor, an intermediate portion, and an outlet for delivering the fluid pressure to the first floor, the intermediate portion located between the inlet and the outlet and adapted for extension from the second floor environmental access and adjacent the first floor environmental access; and a bracing system attachable to said curvilinear tubular structure for supporting said curvilinear tubular structure against the multi-floored building, said bracing system including a rigid frame and boom, said rigid frame extendable from the second floor environmental access and attachable to a portion of the multi-floored building, the rigid frame having an upwardly extending pivot point including a receiver for receiving a portion of said boom, said boom including a pivot point receivable into said receiver such that an outermost portion of said boom may be selectively pivoted upwardly about said pivot point, wherein said curvilinear tubular structure may be attached to said boom for corresponding pivotal movement and selective placement of said curvilinear tubular structure outlet adjacent the first floor environmental access.

2. An apparatus for treating a fire in a multi-floored building, the fire located on a first floor vertically displaced from a second floor from which the fire is treated, the first and second floors each having a selectively openable environmental access along an external wall of the multi-floored building, the apparatus comprising:

a curvilinear tubular structure having an inlet for receiving a fluid pressure at the second floor, an intermediate portion, and an outlet for delivering said fluid pressure to the first floor, said intermediate portion located between the inlet and said outlet and having a length sufficient to extend from the second floor environmental access to adjacent the first floor environmental access via telescopic means;

a bracing system attachable to said curvilinear tubular structure for supporting said curvilinear tubular structure against the multi-floored building, the bracing system comprising a first frame supported against a portion of the multi-floored building adjacent the second floor environmental access, a second frame in an engagement with said first frame and a portion of the multi-floored building within the second floor environmental access, and a boom attached to said curvilinear tubular structure and in engagement with a portion of said first frame and pivotable thereon.

3. The apparatus of claim 2 wherein the bracing system comprises:

a cable attached to a portion of said boom and fixable to said second frame.

4. The apparatus of claim 2 wherein said boom includes a plurality of extension members for increasing the length of said boom.

* * * * *